US005295876A

United States Patent [19]

Cosby et al.

[11] Patent Number: 5,295,876

[45] Date of Patent: Mar. 22, 1994

[54] RESILIENT METAL CONTACT BRUSH

[75] Inventors: Christopher Cosby, Leighton Buzzard; Paul Higgs, Northampton, both of United Kingdom

[73] Assignee: Delco Chassis Overseas Corporation, Detroit, Mich.

[21] Appl. No.: 6,884

[22] Filed: Jan. 21, 1993

[30] Foreign Application Priority Data

Jan. 25, 1992 [GB] United Kingdom ..... 9201661

[51] Int. Cl.[5] ..... H01R 13/00

[52] U.S. Cl. ..... 439/862

[58] Field of Search ..... 439/816, 862, 26, 692–696

[56] References Cited

U.S. PATENT DOCUMENTS

| | | | |
|---|---|---|---|
| 3,323,102 | 5/1967 | Minor | 439/862 |
| 4,445,746 | 5/1984 | Cosby et al. | 339/252 R |
| 4,566,746 | 1/1986 | Hobson | 439/816 |
| 4,691,981 | 9/1987 | Coldren | 439/816 |
| 4,747,794 | 5/1988 | Seidler | 439/862 |

*Primary Examiner*—Joseph M. McGlynn
*Attorney, Agent, or Firm*—Mark A. Navarre

[57] ABSTRACT

A resilient metal contact brush for use in controlling an electric motor, comprises a strip-like metal member having at one end thereof a contact head protruding at an angle to the plane of the strip-like member and at the other end thereof a fixing means. The contact head is an integral portion of the strip-like member and is formed by the juxtaposition of two flat ear-like protrusions formed on the strip-like member adjacent the one end thereof. Each ear-like protrusion is initially located at a respective edge of, and in the plane of, the strip-like member adjacent the one end thereof. The contact head is formed by first bending each ear-like protrusion through an angle of 180° to place it in close contact with a central portion of the strip-like member adjacent the one end, to produce a head portion having at least double the thickness of the strip-like member and then bending the head portion thus formed at an angle to the plane of the strip-like member along a line adjacent the head portion which extends at right angles to a longitudinal axis of the strip-like member. The contact head of the contact brush presents a narrow rectangular contact area for making contact with a contact strip of a control system for a windscreen wiper electric motor.

5 Claims, 2 Drawing Sheets

RESILIENT METAL CONTACT BRUSH

This invention relates to resilient metal contact brushes for use in electric motors, in particular, to resilient metal contact brushes in control systems in direct current windscreen wiper electric motors for use in motor vehicles.

BACKGROUND OF THE INVENTION

Windscreen wiper motors for motor vehicles are customarily provided with a control system built into a gear box portion of the windscreen wiper motor, the control system comprising a series of resilient metal contact brushes which engage a rotary contact member on one of the gears of the motor. These resilient contact brushes form part of the speed control system for the windscreen wiper motor as well as a parking brake system which becomes operable when the windscreen wiper motor is switched off to ensure that the windscreen wiper blades connected to the motor park in the correct position on the windscreen of a motor vehicle to which the windscreen wiper motor is attached. A resilient metal contact brush suitable for use in such a control system is disclosed and claimed in U.S. Pat. No. 4,445,746, issued May 1, 1984, and assigned to the assignee of the present invention. The present invention is an improvement to the resilient metal contact brush disclosed in such patent.

SUMMARY OF THE INVENTION

A resilient metal contact brush, according to the present invention, for use in controlling an electric motor, comprises a strip-like metal member having at one end thereof a contact head protruding at an angle to the plane of the strip-like member and at the other end thereof a fixing means, the contact head being an integral portion of the strip-like member and being formed by the juxtaposition of two flat ear-like protrusions formed on the strip-like member adjacent the one end. Each ear-like protrusion being initially located at a respective edge of, and in the plane of, the strip-like member adjacent the one end thereof.

The contact head is formed by first bending each ear-like protrusion through an angle of 180° to place it in close contact with a central portion of the strip-like member adjacent the one end, to produce a head portion having at least double the thickness of the strip-like member, and then bending the head portion thus formed at an angle to the plane of the strip-like member along a line adjacent the head portion which extends at right angles to a longitudinal axis of the strip-like member.

Preferably the ear-like protrusions are shaped along the edges thereof so that, when the ear-like protrusions are bent through 180° into contact with the central portion of the strip-like member, portions of the edges of the ear-like protrusions come into contact with one another along the longitudinal axis of the strip-like member.

Advantageously, a strengthening rib is also formed in the strip-like member adjacent the bend line about which the head portion is bent relative to the strip-like member, which strengthening rib helps to maintain the contact head at a desired angle to the strip-like member during usage of the brush.

In a preferred embodiment of the present invention, the strip-like member is formed from a resilient metal sheet so that the grain direction of the sheet extends along the longitudinal axis of the strip-like member.

DETAILED DESCRIPTION OF THE INVENTION

Figure 1:
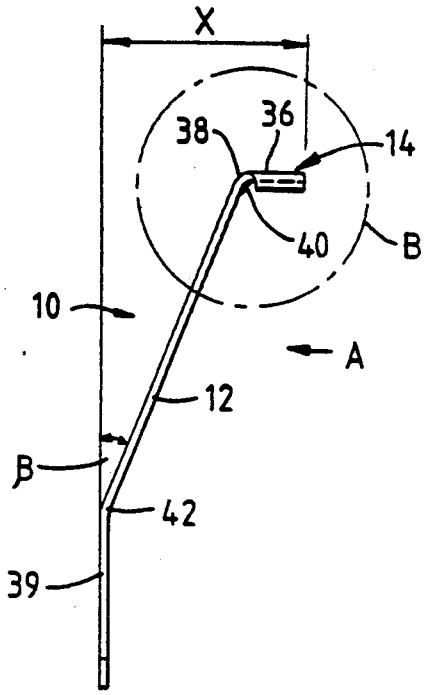
FIG. 1 shows a side view of a resilient metal contact brush according to the present invention.
Figure 2:
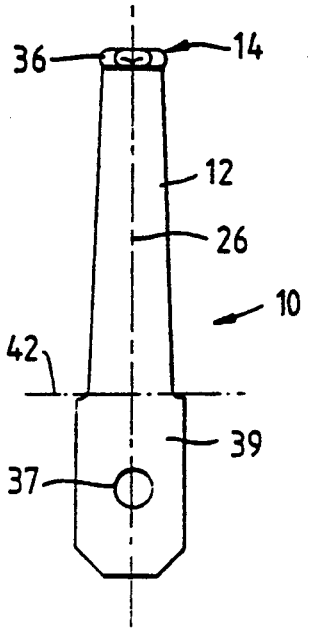
FIG. 2 shows a view of the resilient metal contact brush of FIG. 1 taken in the direction of the arrow A of FIG. 1.

FIGS. 1 and 2 of the accompanying drawings show two views of a resilient metal contact brush 10 according to the present invention, which resilient contact brush comprises a strip-like member 12 having a contact head 14 protruding at an angle to the plane of the strip-like member 12. The contact head 14 is an integral portion of the strip-like member 12 and is produced by deforming an end 16 of a resilient metal blank 18 as shown in FIG. 6 of the drawings in a manner which will be described in more detail hereinafter.

Figure 6:
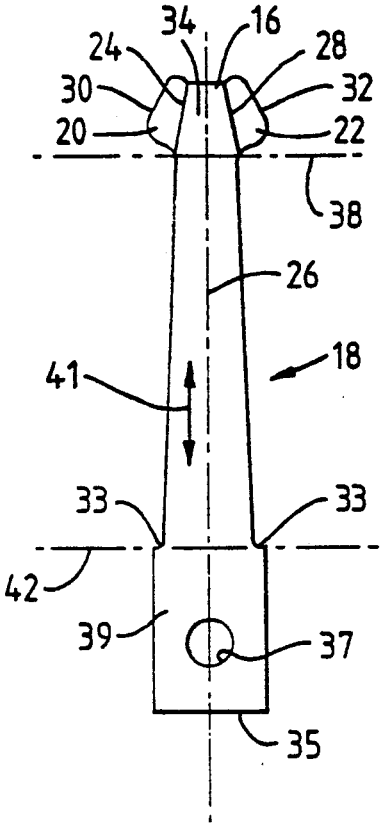
FIG. 6 is a plan view of a resilient metal blank from which the resilient metal contact brush of FIG. 1 is formed.

As can be seen in FIG. 6 of the accompanying drawings, the resilient metal blank 18 has formed at end 16 two protruding ear-like portions 20,22, which extend in substantially opposite directions to one another from the end 16, the ear-like portion 20 extending from a fold line 24 on one side of a longitudinal axis 26 of the blank 18, and the ear-like portion 22 extending from a fold line 28 on the other side of the longitudinal axis 26 of the blank 18. Each ear-like portion has substantially the shape of a truncated isosceles triangle, the sloping sides of which, for the ear-like portion 20, are defined by the fold line 24-and a free edge 30, and, for the ear-like portion 22, are defined by the fold line 28 and a free edge 32. The fold lines 24 and 28 each converge towards the longitudinal axis 26 at an angle within the range of 10°–25°, preferably at an angle of 15°.

Each longitudinal edge of the resilient metal blank 18 below the respective ear-like portion is provided with a step-like portion 33 towards the other end 35 of the blank, which step-like portions 33 define upper edges of a lower fixing portion 39 of the contact brush 10. There is an aperture 37 formed in the lower fixing portion 39, which aperture 37 serves as a fixing means for the resilient metal brush formed from the resilient metal blank 18.

In an alternative embodiment of the invention, not shown, for use in fitting to electric motor gear-box covers formed from a synthetic plastic material, the fixing means provided on the lower fixing portion 39 of the brush comprises one or more metal tangs extending at right angles from the plane of the metal blank, each of which tangs is fitted into, and extends through, a corresponding slot in a gear-box cover when the contact brush is mounted on the gear box cover. In such an embodiment, additional security to the mounting of the contact brush on the gear-box cover is achieved by bending over the portion of each tang which extends from the corresponding slot into contact with a rear surface of the gear-box, so as to anchor the contact brush firmly and securely to the gear-box cover.

The resilient metal blank 18 is formed from a phosphor bronze alloy, and has a thickness in the range of 0.3–0.7 mm, preferably a thickness of 0.4 mm. Preferably the blank 18 is formed from a sheet of the phosphor bronze alloy so that the direction of the grain 41 of the alloy sheet extends substantially parallel to the longitudinal axis 26 of the blank 18, since this achieves a maximum resilience in the formed contact brush, and improves the overall performance of the contact brush.

Figure 5:
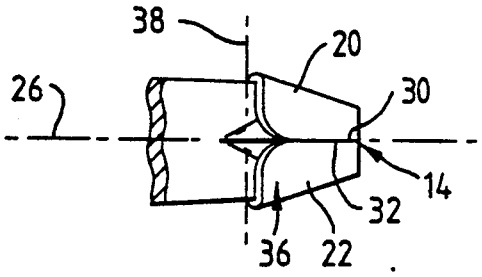
FIG. 5 shows a view of the portion of the resilient metal contact brush shown in FIG. 3, taken in the direction of the arrow D of FIG. 3.

The resilient metal contact brush 10 is formed from the resilient metal blank 18 by first bending the ear-like portions 20, 22 through 180° about their respective fold lines 24,28 by cold-forming, so that they both come into close contact with the same side of a central portion 34 of the resilient metal blank 18 adjacent the end 16 thereof, and so that the free edges 30, 32 thereof abut one another along the longitudinal axis 26 of the resilient metal blank 18 to produce a head portion 36 having double the thickness of the resilient metal blank 18, as can be seen in FIG. 5 of the drawings.

The head portion 36 thus formed is then bent through an angle $\alpha$ (see FIG. 3) relative to the remaining portion of the resilient metal blank about a fold line 38 adjacent the head portion 36, which fold line 38 extends at right angles to the longitudinal axis 26 of the resilient metal blank 18. Once the head portion 36 is at the desired angle to the remaining portion of the blank 18, a strengthening rib 40 (see FIG. 4) is cold-formed in the blank 18 along the longitudinal axis 26 thereof, which strengthening rib 40 crosses the fold line 38 and locally stiffens the contact brush 10 in the region of the fold line 38, thus helping to maintain the desired angle of the head portion 36 to the remaining portion of the blank 18. The angle $\alpha$ through which the head portion 36 is bent typically varies over a range of 60°–68°.

In the embodiment of the invention disclosed in the drawings, the angle a through which the head portion 36 is bent is 67°. Finally, the lower fixing portion 39 of the blank 18 has the lower corners thereof removed at a substantially 45° angle, as shown in FIG. 2 of the drawings, and then the lower fixing portion 39 is bent through an angle $\beta$ to the plane of the blank 18 about a fold line 42 extending through the upper edges of the lower fixing portion 39 at right angles to the longitudinal axis of the blank 18, the direction of bending of the lower portion 39 being towards the head portion 36, so as to produce the resilient metal contact brush 10 as shown in FIGS. 1 and 2 of the drawings. The angle $\beta$ through which the lower fixing portion 39 is bent typically varies over a range of 22°–300. In the embodiment of the invention disclosed in the drawings, the angle $\beta$ through which the lower portion 39 is bent is 23°.

Figure 7:
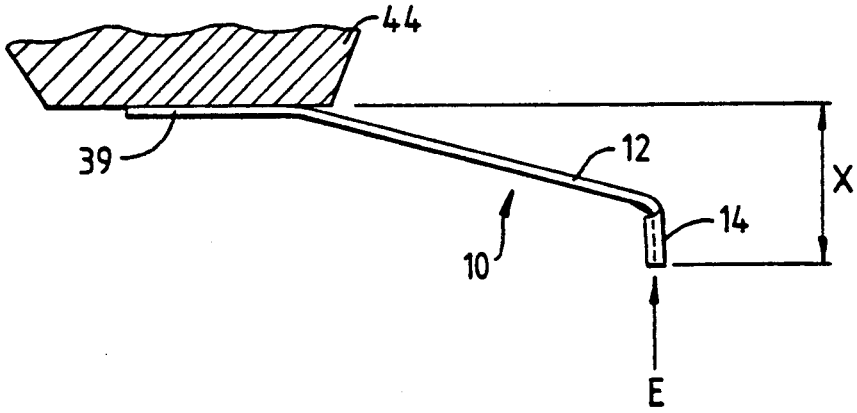
FIG. 7 is a side view of the resilient metal contact brush of FIG. 1, when installed in an electric motor (not shown) and subjected to a deflecting force applied to the contact head of the brush in the direction of the arrow E, indicative of the expected contact pressure between the contact head and a contact track (not shown) of the motor during operation of the motor.

Turning now to FIG. 7, this drawing illustrates the resilient metal contact brush 10 illustrated in FIGS. 1 and 2 mounted on a support 44 in an electric motor gear-box (not shown), the contact head 14 of the brush 10 being subjected to a contact pressure of 2.0–3.1N in the direction of the arrow E. This contact pressure force causes the contact brush to deflect so that the angle between the lower fixing portion 39 of the contact brush 10 and the remaining portion of the brush 10 decreases to 15°, and to reduce the distance between the tip of the contact head 14 and a line extending through the plane of the lower fixing portion 39 (shown as the distance X on FIG. 7) to 82.85% of the same distance as measured with the resilient metal contact brush 10 in an unloaded state, as shown in FIG. 1.

Figure 3:
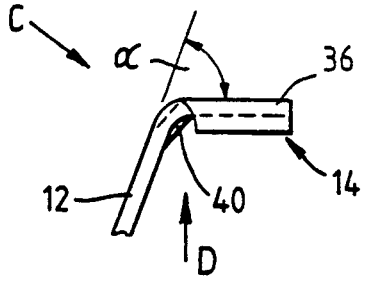
FIG. 3 shows an enlarged view of the portion of the resilient metal contact brush of FIG. 1 shown in the circle B of FIG. 1.
Figure 4:
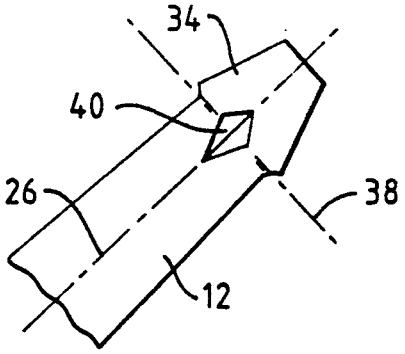
FIG. 4 shows a view of the portion of the resilient metal contact brush shown in FIG. 3, taken in the direction of the arrow C of FIG. 3.

As will be appreciated from the enlarged views of the contact head 14 shown in FIGS. 3, 4 and 5 of the drawings, the tip of the contact head is effectively a narrow rectangular shape. When the resilient metal contact brush 10 is mounted in a gear-box of an electric motor so that the tip of the contact head 14 is pressed against a contact track on a gearwheel in that gear-box, the direction of movement of that contact track relative to the tip of the contact head 14 is along the longitudinal axis of the narrow rectangular tip.

This feature of the contact brush 10 means that the width of the corresponding contact track can be reduced considerably without any risk of diminishing the contact area between the contact head 14 and the contact track, and this helps considerably to reduce the overall size of the control system containing the contact brush 10. moreover, during usage of the contact brush 10 in such a control system, the specific design of the contact head 14 of the contact brush 10 results in better wear resistance of the tip of the contact head 14, leading to better contact life of the contact head 14 on the corresponding contact track in the control system.

The resilient metal contact brush of the present invention gives a substantial improvement in wear and operating properties over known prior-art contact brushes, and is both simple and economic to manufacture by mass-production techniques.

The embodiments of the invention in which an exclusive property or privilege is claimed are defined as follows:

1. A resilient metal contact brush comprising: a strip-like metal member having at one end thereof a contact head protruding at an angle to the plane of the strip-like member and at the other end thereof a fixing means, said contact head being an integral portion of the strip-like member and being formed by the juxtaposition of two flat ear-like protrusions formed on the strip-like member adjacent said one end thereof, each ear-like protrusion being initially located at a respective edge of, and in the plane of, said strip-like member adjacent said one end thereof, characterized in that the contact head is formed by first bending each ear-like protrusion through an angle of 180° to place it in close contact with a central portion of the strip-like member adjacent said one end, to produce a head portion having at least double the thickness of the strip-like member, and then bending the head portion thus formed at an angle to the plane of the strip-like member along a bend line adjacent said head portion which extends at right angles to a longitudinal axis of the strip-like member.

2. A resilient metal contact brush according to claim 1, in which the ear-like protrusions are shaped along the edges thereof so that, when the ear-like protrusions are bent through 180° into contact with the central portion of the strip-like member, portions of the edges of the ear-like protrusions come into contact with one another along the longitudinal axis of the strip-like member.

3. A resilient metal contact brush according to claim 1, in which a strengthening rib is also formed in the strip-like member adjacent the bend line about which the head portion is bent relative to the strip-like member, which strengthening rib helps to maintain the contact head at a desired angle to the strip-like member during usage of the brush.

4. A resilient metal contact brush according to claim 1, in which the strip-like member is formed from a resilient metal sheet having a grain direction extending along the longitudinal axis of the strip-like member.

5. A resilient metal contact brush according to claims 1, in which the fixing means at said other end of the contact brush comprises a fixing aperture formed in the strip-like metal member.

* * * * *